US008485863B2

(12) United States Patent
Naik

(10) Patent No.: US 8,485,863 B2
(45) Date of Patent: Jul. 16, 2013

(54) POLISHING LIQUIDS FOR ACTIVATING AND/OR CONDITIONING FIXED ABRASIVE POLISHING PADS, AND ASSOCIATED SYSTEMS AND METHODS

(75) Inventor: Sujit Naik, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 1205 days.

(21) Appl. No.: 11/639,659

(22) Filed: Dec. 15, 2006

(65) Prior Publication Data

US 2007/0093185 A1 Apr. 26, 2007

Related U.S. Application Data

(63) Continuation of application No. 10/923,573, filed on Aug. 20, 2004, now Pat. No. 7,153,191.

(51) Int. Cl.

| | |
|---|---|
| ***B24B 1/00*** | (2006.01) |
| ***B24B 7/19*** | (2006.01) |
| ***B24B 7/30*** | (2006.01) |
| ***B24B 49/00*** | (2012.01) |
| ***B24B 51/00*** | (2006.01) |
| ***B24B 5/00*** | (2006.01) |
| ***B24B 29/00*** | (2006.01) |

(52) U.S. Cl.
USPC ..... 451/41; 451/8; 451/9; 451/285

(58) Field of Classification Search
USPC ..... 451/8, 5, 9, 285–288, 443–444, 11, 451/21, 28, 56
See application file for complete search history.

(56) References Cited

U.S. PATENT DOCUMENTS

| | | | |
|---|---|---|---|
| 5,209,816 | A | 5/1993 | Yu et al. |
| 5,225,034 | A | 7/1993 | Yu et al. |
| 5,354,490 | A | 10/1994 | Yu et al. |
| 5,540,810 | A | 7/1996 | Sandhu et al. |
| 5,616,069 | A | 4/1997 | Walker et al. |
| 5,645,682 | A | 7/1997 | Skrovan |
| 5,655,951 | A | 8/1997 | Meikle et al. |
| 5,725,417 | A | 3/1998 | Robinson |
| 5,779,522 | A | 7/1998 | Walker et al. |
| 5,782,675 | A | 7/1998 | Southwick |
| 5,801,066 | A | 9/1998 | Meikle |

(Continued)

OTHER PUBLICATIONS

U.S. Appl. No. 11/580,784, filed Oct. 13, 2006, Naik.

(Continued)

*Primary Examiner* — Joseph J Hail
*Assistant Examiner* — Alvin Grant
(74) *Attorney, Agent, or Firm* — Perkins Coie LLP

(57) ABSTRACT

Polishing liquids for activating and/or conditioning fixed abrasive polishing pads, and associated systems and methods are disclosed. A method in accordance with one embodiment of the invention includes disposing a polishing liquid on a polishing surface of a microfeature workpiece polishing pad. The polishing pad can include a matrix material and a plurality of abrasive elements fixedly distributed in the matrix material. The polishing liquid can include a plurality of particles that are at least approximately chemically inert with respect to the abrasive elements. In a particular embodiment, the particles can have a polymeric, non-ceramic composition. The method can further include moving at least one of the polishing pad and the plurality of particles relative to the other to remove deposits from the polishing pad. This operation can be performed serially or simultaneously with using the polishing pad to remove material from a microfeature workpiece.

23 Claims, 4 Drawing Sheets

U.S. PATENT DOCUMENTS 5,827,781 A 10/1998 Skrovan et al.
5,833,519 A 11/1998 Moore
5,846,336 A 12/1998 Skrovan
5,879,226 A 3/1999 Robinson
5,895,550 A 4/1999 Andreas
5,910,043 A 6/1999 Manzonie et al.
5,916,819 A 6/1999 Skrovan et al.
5,975,994 A 11/1999 Sandhu et al.
5,990,012 A 11/1999 Robinson et al.
5,994,224 A 11/1999 Sandhu et al.
6,004,196 A 12/1999 Doan et al.
6,040,245 A 3/2000 Sandhu et al.
6,060,395 A 5/2000 Skrovan et al.
6,074,286 A 6/2000 Ball
6,077,785 A 6/2000 Andreas
6,083,085 A 7/2000 Lankford
6,116,988 A 9/2000 Ball
6,124,207 A 9/2000 Robinson et al.
6,136,218 A 10/2000 Skrovan et al.
6,176,763 B1 1/2001 Kramer et al.
6,187,681 B1 2/2001 Moore
6,196,899 B1 3/2001 Chopra et al.
6,203,404 B1 3/2001 Joslyn et al.
6,203,413 B1 3/2001 Skrovan
6,206,756 B1 3/2001 Chopra et al.
6,206,757 B1 3/2001 Custer et al.
6,220,934 B1 4/2001 Sharples et al.
6,234,874 B1 5/2001 Ball
6,234,877 B1 5/2001 Koos et al.
6,238,270 B1 5/2001 Robinson
6,250,994 B1 6/2001 Chopra et al.
6,267,650 B1 7/2001 Hembree
6,271,139 B1 8/2001 Alwan et al.
6,273,786 B1 8/2001 Chopra et al.
6,273,800 B1 8/2001 Walker et al.
6,276,996 B1 8/2001 Chopra
6,306,008 B1 10/2001 Moore
6,306,012 B1 * 10/2001 Sabde ..... 451/41
6,306,768 B1 10/2001 Klein
6,312,486 B1 11/2001 Sandhu et al.
6,312,558 B2 11/2001 Moore
6,313,038 B1 11/2001 Chopra et al.
6,331,139 B2 12/2001 Walker et al.
6,337,281 B1 * 1/2002 James et al. ..... 51/294
6,338,744 B1 * 1/2002 Tateyama et al. ..... 51/308
6,350,180 B2 2/2002 Southwick
6,350,691 B1 2/2002 Lankford
6,352,470 B2 3/2002 Elledge
6,354,917 B1 3/2002 Ball
6,354,923 B1 3/2002 Lankford
6,354,930 B1 3/2002 Moore
6,361,411 B1 3/2002 Chopra et al.
6,361,413 B1 3/2002 Skrovan
6,368,194 B1 4/2002 Sharples et al.
6,368,197 B2 4/2002 Elledge
6,375,548 B1 4/2002 Andreas
6,376,381 B1 4/2002 Sabde
6,402,884 B1 6/2002 Robinson et al.
6,407,000 B1 6/2002 Hudson
6,488,570 B1 * 12/2002 James et al. ..... 451/36
6,533,893 B2 3/2003 Sabde et al.
6,548,407 B1 4/2003 Chopra et al.
6,565,618 B1 * 5/2003 Ishizuka ..... 51/307
6,579,799 B2 6/2003 Chopra et al.
6,589,101 B2 * 7/2003 Sabde et al. ..... 451/41
6,638,143 B2 * 10/2003 Wang et al. ..... 451/41
6,648,733 B2 * 11/2003 Roberts et al. ..... 451/41
6,659,846 B2 * 12/2003 Misra et al. ..... 451/41
6,666,749 B2 12/2003 Taylor
6,688,957 B2 * 2/2004 Tolles ..... 451/532
6,712,676 B2 * 3/2004 Chopra et al. ..... 451/56
6,790,883 B2 * 9/2004 Ogawa et al. ..... 524/47
6,939,211 B2 * 9/2005 Taylor et al. ..... 451/60
6,953,388 B2 * 10/2005 Shimagaki et al. ..... 451/41
6,976,910 B2 * 12/2005 Hosaka et al. ..... 451/530
6,986,705 B2 * 1/2006 Preston et al. ..... 451/526
6,992,123 B2 * 1/2006 Shiho et al. ..... 524/17
7,077,879 B2 * 7/2006 Ogawa et al. ..... 51/298
2002/0052174 A1 * 5/2002 Nishimura et al. ..... 451/54
2002/0188370 A1 * 12/2002 Saldana et al. ..... 700/121
2003/0063271 A1 * 4/2003 Nicholes et al. ..... 356/36
2004/0014399 A1 * 1/2004 Wang et al. ..... 451/36
2004/0116051 A1 * 6/2004 Kramer ..... 451/56
2004/0121709 A1 6/2004 Wang
2004/0242121 A1 * 12/2004 Hirokawa et al. ..... 451/5
2005/0164613 A1 * 7/2005 Seike et al. ..... 451/56
2005/0186891 A1 * 8/2005 Benner ..... 451/56
2006/0040591 A1 2/2006 Naik
2006/0211250 A1 * 9/2006 Hou et al. ..... 438/692

OTHER PUBLICATIONS

Kondo, S. et al., "Abrasive-Free Polishing for Copper Damascene Interconnnection," Journal of the Electrochemical Society, vol. 147, No. 10, pp. 3907-3913, The Electrochemical Society, Inc., 2000.

JSR Micro, Inc., JSR CMP Slurry, 3 pages, retrieved from the Internet on Jun. 23, 2004, <http://www.jsrmicro.com/pro_CMP_slurry.html>.

JSR Micro, Inc., JSR CMP Pad, 3 pages, retrieved from the Internet on Jun. 23, 2004, <http://www.jsrmicro.com/pro_CMP_pad.html>.

* cited by examiner

POLISHING LIQUIDS FOR ACTIVATING AND/OR CONDITIONING FIXED ABRASIVE POLISHING PADS, AND ASSOCIATED SYSTEMS AND METHODS

CROSS-REFERENCE TO RELATED APPLICATION

This application is a continuation of U.S. patent application Ser. No. 10/923,573, filed Aug. 20, 2004, now U.S. Pat. No. 7,153,191, which is incorporated herein by reference in its entirety.

TECHNICAL FIELD

The present invention relates generally to polishing liquids for activating and/or conditioning fixed abrasive polishing pads, and associated systems and methods.

BACKGROUND

Mechanical and chemical-mechanical planarization and polishing processes (collectively "CMP") remove material from the surfaces of microfeature workpieces in the production of microelectronic devices and other products. FIG. 1A schematically illustrates a rotary CMP machine 10 having a platen 22, a polishing pad 20 on the platen 22, and a carrier 30 adjacent to the polishing pad 20. The CMP machine 10 may also have an under-pad 23 between an upper surface 21 of the platen 22 and a lower surface of the polishing pad 20. A platen drive assembly 24 rotates the platen 22 (as indicated by arrow A) and/or reciprocates the platen 22 back and forth (as indicated by arrow B). Because the polishing pad 20 is attached to the under-pad 23, the polishing pad 20 moves with the platen 22 during planarization.

The carrier 30 has a carrier head 31 with a lower surface 33 to which a microfeature workpiece 12 may be attached, or the workpiece 12 may be attached to a resilient pad 32 under the lower surface 33. The carrier head 31 may be a weighted, free-floating wafer carrier, or a carrier actuator assembly 34 may be attached to the carrier head 31 to impart rotational motion to the microfeature workpiece 12 (as indicated by arrow C) and/or reciprocate the workpiece 12 back and forth (as indicated by arrow D).

The polishing pad 20 and a polishing solution 50 define a polishing medium 51 that mechanically and/or chemically-mechanically removes material from the surface of the microfeature workpiece 12. The polishing solution 50 may be a conventional CMP slurry with abrasive particles and chemicals that etch and/or oxidize the surface of the microfeature workpiece 12, or the polishing solution 50 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads. Abrasive slurries can include suspensions of fumed or colloidal abrasive ceramics such as silica, ceria or alumina, or suspensions of particles that are formed from a composite of colloidal silica and a polymer. Such slurries are available from JSR Micro of Sunnyvale, Calif.

To planarize the microfeature workpiece 12 with the CMP machine 10, the carrier head 31 presses the workpiece 12 face-down against the polishing pad 20. More specifically, the carrier head 31 generally presses the microfeature workpiece 12 against the polishing solution 50 on a polishing surface 25 of the polishing pad 20, and the platen 22 and/or the carrier head 31 move to rub the workpiece 12 against the polishing surface 25. As the microfeature workpiece 12 rubs against the polishing surface 25, the polishing medium 51 removes material from the face of the workpiece 12.

The CMP process must consistently and accurately produce a uniformly planar surface on the microfeature workpiece 12 to enable precise fabrication of circuits and photo-patterns. One problem with existing CMP methods is that the polishing surface 25 of the polishing pad 20 can wear unevenly or become glazed with accumulations of polishing solution 50 and/or material removed from the microfeature workpiece 12 and/or the polishing pad 20. To restore the planarizing/polishing characteristics of the polishing pad 20, the pad 20 is typically conditioned by removing the accumulations of waste matter with a conditioner 40. Such conditioners and conditioner assemblies are available on most CMP polishing tools, such as those manufactured by Applied Materials of Santa Clara, Calif. under the trade name Mirra.

The existing conditioner 40 typically includes an abrasive end effector 41 having a head 45 generally embedded with diamond abrasives. The head 45 is attached to a shaft 42 which connects to a shaft housing 49. The shaft housing 49 is supported relative to the polishing pad 20 by an arm 43 and a support housing 44. A motor 46 within the support housing 44 rotates the shaft housing 49, the shaft 42 and the head 45 (as indicated by arrow E) via a pair of pulleys 47*a*, 47*b* and a connecting belt 48. The conditioner 40 can also include a separate actuator (not shown in FIG. 1A) that sweeps the arm 43 and the end effector 41 back and forth (as indicated by arrow F). A bladder 39 rotates with the shaft 42 and applies a normal force to the head 45 (as indicated by arrow G) to press the head 45 against the polishing pad 20. The end effector 41 accordingly removes a thin layer of the polishing pad material in addition to the waste matter to form a new, clean polishing surface 25 on the polishing pad 20.

One drawback with the foregoing arrangement described above with reference to FIG. 1A is that the end effector 41 may not be suitable for conditioning a fixed abrasive polishing pad. For example, the end effector 41 can tear the material forming the polishing pad 20, reducing the uniformity of the polishing surface 25, and therefore reducing the uniformity with which the polishing pad 20 removes material from subsequent workpieces. Conventional slurries, which include a suspension of ceramic particles, tend to have the same effect on a fixed abrasive polishing pad.

One approach to addressing the foregoing drawback is to brush the polishing pad 20, either after the conditioning process or instead of the conditioning process. FIG. 1B illustrates a brush 38 having bristles 37 that pass over the polishing surface 25 of the polishing pad 20. Accordingly, the bristles 37 clean the exposed surfaces of fixed abrasive elements 26 embedded in projections 19 of the polishing pad 20. One drawback with this arrangement is that it has only a limited beneficial effect on the polishing rate of the polishing pad 20. One possible explanation for this result is that the bristles 37 are relatively large in comparison to the abrasive elements 26 and the contact between the bristles 37 and the abrasive elements 26 is not uniform. Another possible explanation is that the bristles 37 can extend into the gaps 18 between adjacent projections 19 in which the abrasive elements 26 are housed. Accordingly, the bristles 37 can loosen deposits and/or pad material in these regions, which can cause scratching or other defects in workpieces that are subsequently processed with the polishing pad 20.

DETAILED DESCRIPTION

Figure 1A:
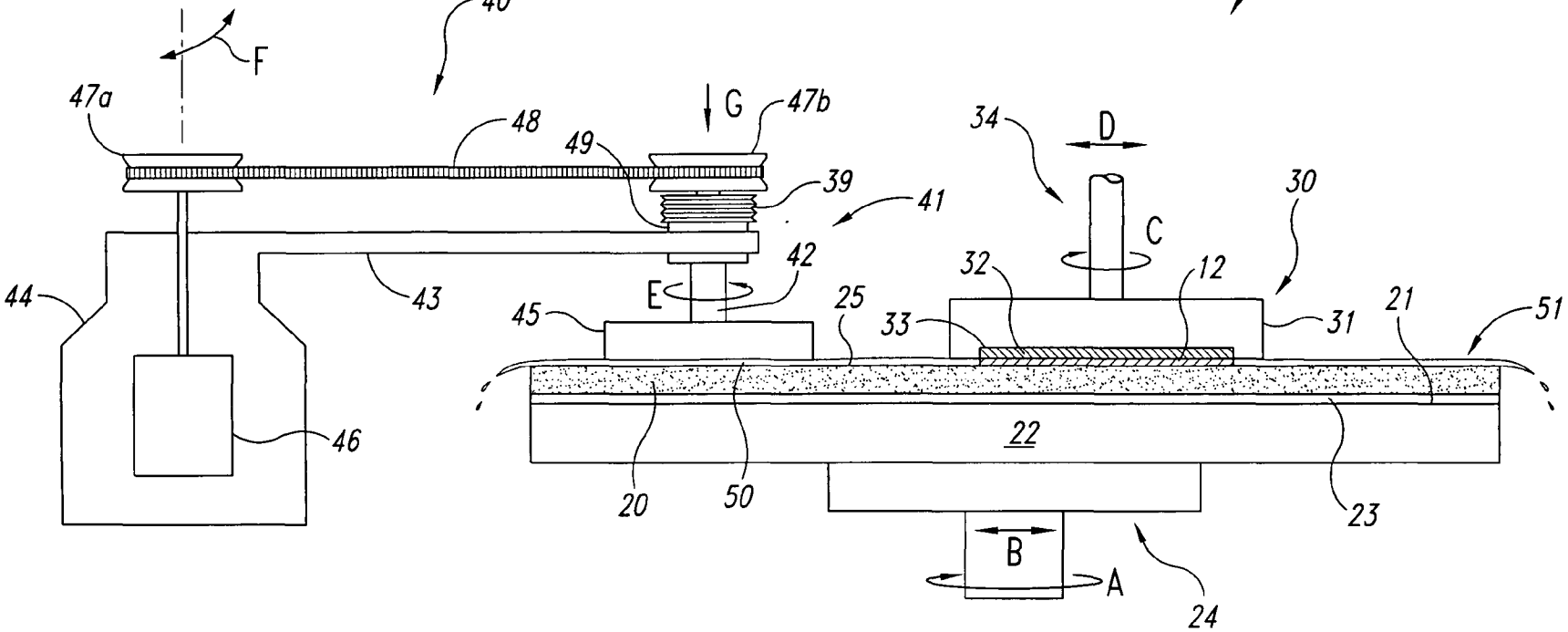
Fig. 1A (Prior Art)
FIG. 1A is a partially schematic, side elevation view of a CMP system having a polishing pad and conditioner arranged in accordance with the prior art.

The present invention is directed generally toward polishing liquids for conditioning and/or activating fixed abrasive polishing pads, and associated systems and methods. A method in accordance with one aspect of the invention includes disposing a polishing liquid on a polishing surface of a microfeature workpiece polishing pad. The polishing pad can include a matrix material and a plurality of abrasive elements fixedly distributed in the matrix material. The polishing liquid can include particles that are at least approximately chemically inert with respect to the abrasive elements. The method can further include moving at least one of the polishing pad and the plurality of particles relative to the other to remove deposits from the polishing pad.

In particular aspects of the invention, the method can further include contacting a microfeature workpiece with the polishing pad and moving at least one of the polishing pad and the microfeature workpiece relative to the other to remove material from the microfeature workpiece. The material can be removed from the microfeature workpiece simultaneously with, or serially with, removing deposits from the polishing pad. In yet another aspect of the invention, the method can include placing a generally rigid member (that does not include a microelectronic workpiece) in contact with the polishing pad and the polishing liquid, and then moving at least one of the polishing pad and the generally rigid member relative to the other to remove deposits from the polishing pad.

Another aspect of the invention is directed to a polishing medium for removing material from a microfeature workpiece. The polishing medium can include a polishing pad that in turn includes a matrix material and a plurality of abrasive elements fixedly dispersed in the matrix material. The polishing medium can further include a polishing liquid adjacent to the polishing pad. The polishing liquid can include deionized water and a plurality of particles in the deionized water, with the particles being at least approximately chemically inert with respect to the abrasive elements. In further particular aspects of the invention, the plurality of particles can include particles having a polymeric, non-ceramic composition (e.g., including but not limited to polymethylmethacrylate, polystyrene, polyvinyl alcohol, polyethylene, polycarbonate, polyester, polyurethane and composites thereof). The particles can have an average diameter in the range of from about 20 nanometers to about five hundred microns, a concentration in the polishing liquid of from about 20 ppm to about 5%, and a hardness less than a hardness of the abrasive elements.

As used herein, the terms "microfeature workpiece" and "workpiece" refer to substrates on and/or in which microelectronic devices are integrally formed. Microfeature polishing pads include pads configured to remove material from microfeature workpieces during the formation of microdevices. Typical microdevices include microelectronic circuits or components, thin-film recording heads, data storage elements, microfluidic devices, and other products. Micromachines and micromechanical devices are included within this definition because they are manufactured using much of the same technology that is used in the fabrication of integrated circuits. The substrates can be semiconductive pieces (e.g., doped silicon wafers or gallium arsenide wafers), nonconductive pieces (e.g., various ceramic substrates) or conductive pieces. In some cases, the workpieces are generally round, and in other cases the workpieces have other shapes, including rectilinear shapes. Several embodiments of polishing liquids and associated systems and methods are described below. A person skilled in the relevant art will understand, however, that the invention may have additional embodiments, and that the invention may be practiced without several of the details of the embodiments described below with reference to FIGS. 2-4.

Figure 2:
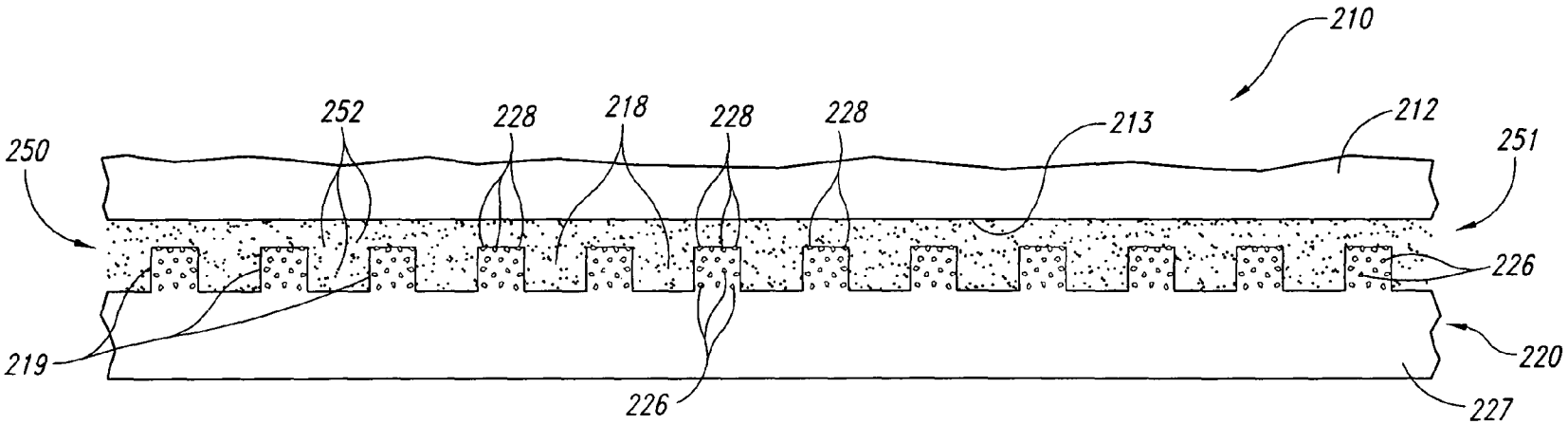
FIG. 2 is a partially schematic, side elevation view of a portion of a polishing pad and polishing liquid configured to condition and/or activate the polishing pad in accordance with an embodiment of the invention.

FIG. 2 is a partially schematic, cross-sectional view of a portion of a system 210 configured to remove material from a microfeature workpiece 212 in accordance with an embodiment of the invention. The system 210 can include a polishing medium 251 positioned adjacent to the microfeature workpiece 212, so that relative movement between the microfeature workpiece 212 and the polishing medium 251 removes material from a face 213 of the microfeature workpiece 212. This movement (or relative movement between constituents of the polishing medium 251) can also activate and/or condition the polishing medium 251. Activating and/or conditioning the polishing medium 251 can in turn increase the speed, efficiency, and uniformity with which the polishing medium 251 removes material from the microfeature workpiece 212, and can provide stable performance as described in greater detail below. The arrangement can also reduce polish-related defects on the microfeature workpiece surface.

The polishing medium 251 can include a polishing pad 220 and a polishing liquid 250. The polishing pad 220 can include a plurality of abrasive elements 226 distributed in a matrix material 227. In a particular embodiment, the matrix material 227 can include pillars or other projections 219 in which the abrasive elements 226 are housed. The abrasive elements 226 can include ceria, silica, alumina and/or other relatively hard constituents, and can have a variety of shapes and sizes. For example, the abrasive elements 226 can be regular or irregular in shape, and can have a size (e.g., mean diameter) in the range of from about 20 nanometers to several hundred microns. The matrix material 227 in which the abrasive elements 226 are positioned can include a polymeric resin material that carries the abrasive elements 226 in contact with the microfeature workpiece 212. The matrix material 227 wears away during use so that new abrasive elements 226 are continually exposed. Suitable fixed-abrasive polishing pads are available from 3M of St. Paul, Minn.

Figure 1B:
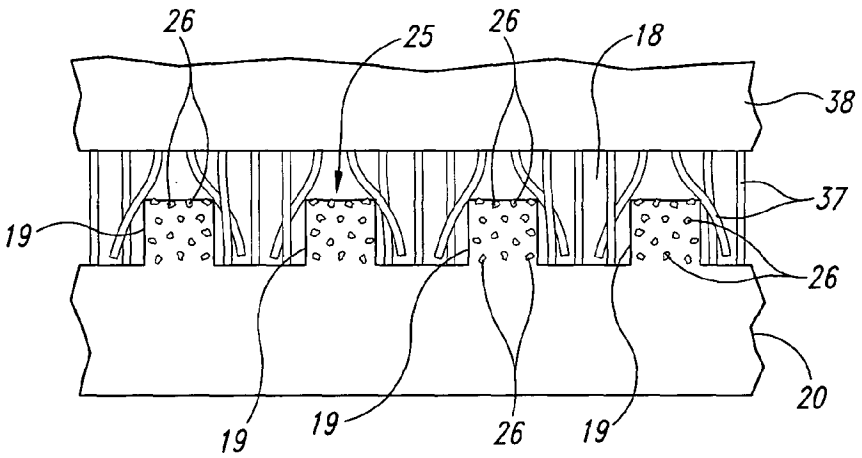
Fig. 1B (Prior Art)
FIG. 1B is an enlarged, partially schematic illustration of a portion of a polishing pad and a brush used to clean the polishing pad in accordance with the prior art.

The polishing liquid 250 can include a plurality of particles 252 suspended in a liquid medium, e.g., deionized water. The particles 252 are configured and distributed so that they can remove deposits from exposed surfaces 228 of the abrasive elements 226, without creating at least some of the drawbacks described above with reference to FIGS. 1A and 1B. For example, the particles 252 can be formed from a material that is at least approximately chemically inert with respect to the abrasive elements 226. Accordingly, the particles 252 can polish, condition and/or activate the abrasive elements 226 via a mechanical rather than a chemical action. The particles 252 can be formed from a polymer and can be formed without ceramic constituents. Accordingly, the particles 252 can have at least some resilient flexibility. As a result, the particles 252 can be less likely to tear up or otherwise damage the matrix material 227 of the polishing pad 220. In particular embodiments, the particles 252 can include polymethylmethacrylate, polyethylene, polycarbonate, polyester, polyurethane, polystyrene, and/or polyvinyl alcohol. In other embodiments, the particles 252 can include other polymers. The particular polymer selected for the particles 252 can be chosen on the basis of hardness, among other factors. For example, the particles 252 can have a hardness that is less than the hardness of the abrasive elements 226.

The particles 252 can also be selected to have a particular concentration in the polishing liquid 250. For example, the particles 252 can have a concentration in the range of from about 20 ppm to about 5%. In general, higher concentrations result in increased rates at which deposits are removed from the abrasive elements 226, though it is expected that at some elevated concentrations, this effect will level off or even drop off.

Another feature of the particles 252 is that they can have a relatively small size, e.g., on the same order as the size of the abrasive elements 226. For example, in particular embodiments, the particles 252 can be generally spherical in shape and can have a size (e.g., diameter) that ranges from about 20 nanometers to about five hundred microns. In a further particular embodiment, the particles 252 can have a size of about 200 nanometers (e.g., the particles 252 can include nanoparticles). As will be understood by those of ordinary skill in the relevant art, a polishing liquid 250 having particles 252 selected for a particular size will likely have particles with a range of sizes such that an average of the range corresponds to the selected particle size. In any of these embodiments, the size of the particles 252 relative to the size of the abrasive elements 226 can allow the particles 252 to perform a mechanical "micro-cleaning" function. Accordingly, the particles 252 can scrub the exposed surfaces 228 of the abrasive elements 226. The maximum size of the particles 252 can be selected to correspond to the size at which the particles cease to effectively remove deposits from the abrasive elements 226, and/or the size at which the particles 252 cause damage to the microfeature workpiece 212.

Because the particles 252 are relatively small, they can easily fit in the gaps or interstices 218 between neighboring projections 219 of the polishing pad 220. An advantage of this arrangement is that the particles 252 in the interstices 218 are unlikely to create direct forces on the matrix material 227 in these regions because the particles 252 remain suspended in the polishing liquid 250. Accordingly, the particles 252 are not compressed by the workpiece 212 into direct contact with the matrix material 227 in the interstices 218. As a result, the particles 252 can be less likely to remove the matrix material 227 in the interstices 218. The particles 252 can also be less likely to loosen deposits of microfeature workpiece material located in the interstices 218. This arrangement can not only eliminate the need for brushing the polishing pad 220 (a process described above with reference to FIG. 1B), but can also produce a cleaner, more uniform polishing surface 225 than can be produced by brushing the polishing pad 220.

The polishing liquid 250 can include constituents in addition to the particles 252 and deionized water. For example, the polishing liquid 250 can include additives provided to adjust the pH of the polishing liquid 250. Accordingly, different polishing liquids 250 can be selected to remove different types of materials from the microfeature workpiece 212. In particular, the polishing liquid 250 can have an acidic pH for removing metallic films and/or other metal materials from the microfeature workpiece 212, and an alkaline pH for removing oxide materials from the microfeature workpiece 212. The polishing liquid 250 can also include other additives, for example, surfactants, and/or dispersants to prevent agglomeration of the particles 252. In further embodiments, the polishing liquid 250 can include still further constituents, for example, constituents that provide additional selectivity for removing particular materials from the microfeature workpiece 212.

Polishing liquids 250 having particles 252 with any of a wide variety of combinations of features (including particle size, shape, composition and concentration) can be made available to the user to address a multitude of polishing needs. Accordingly, the user can select one or more polishing liquids 250 based on the characteristics of a particular microfeature workpiece 212, and/or the characteristics of an associated polishing pad 220.

As discussed above, one feature of embodiments of the system 210 is that the particles 252 can be more effective than conventional brushes and end effectors for conditioning the polishing pad 220. Another feature of an embodiment of the system 210 described above with reference to FIG. 2 is that the particles 252 in the polishing liquid 250 can activate and/or condition the polishing pad 220 while the polishing pad 220 simultaneously removes material from the microfeature workpiece 212. An advantage of this arrangement is that the polishing pad 220 need not be activated and/or conditioned in a separate operation. Accordingly, the amount of time required to process a multitude of microfeature workpieces 212 can be significantly reduced because polishing operations on the microfeature workpieces 212 need not be interrupted to condition the polishing pad 220.

The foregoing arrangement described with reference to FIG. 2 can have advantages even for existing systems (such as the one described above with reference to FIG. 1A) that are set up to polish a microfeature workpiece with one portion of a polishing pad while another portion of the polishing pad is conditioned. For example, unlike the arrangement shown in FIG. 1A, the arrangement described above with reference to FIG. 2 does not require an end effector 41. Accordingly, the system 210 can be simpler and therefore less expensive, both to manufacture and to operate.

Figure 3:
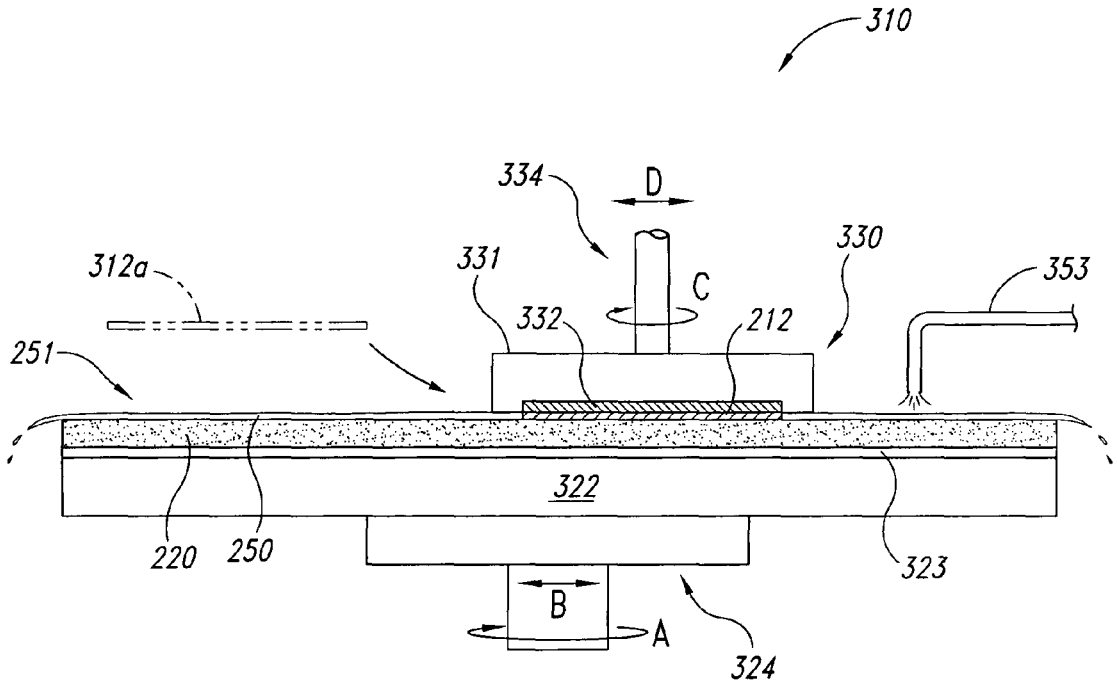
FIG. 3 is a partially schematic illustration of a system that includes a polishing pad and polishing liquid configured to condition and/or activate the polishing pad in accordance with another embodiment of the invention.

In other embodiments, an arrangement generally similar to that described above with reference to FIG. 2 can be used to polish a workpiece 212 and condition the polishing pad 220 in a serial, rather than simultaneous, operation. Referring now to FIG. 3, a system 310 can include a platen 322 or other support that carries the polishing pad 220, optionally with an underpad 323 positioned between the platen 322 and the polishing pad 220. A drive assembly 324 can rotate the platen 322 and the polishing pad 220 (as indicated by arrow A) and translate the platen 322 and the polishing pad 220 (as indicated by arrow B). The polishing liquid 250 can be disposed on the polishing pad 220 to form the polishing medium 251 for removing material from the microfeature workpiece 212.

The microfeature workpiece 212 can be supported relative to the polishing pad 220 with a carrier 330. Accordingly, the carrier 330 can include a carrier head 331 and, optionally, a resilient pad 322 that supports the workpiece 212 relative to the polishing pad 220. The carrier 330 can include a carrier actuator assembly 334 that rotates the carrier head 331 and the workpiece 212 (as indicated by arrow C) and/or translates the carrier head 331 and the workpiece 212 (as indicated by arrow D). The relative movement between the polishing pad 220 and the workpiece 212 chemically and/or chemically-mechanically removes material from the surface of the workpiece 212 during polishing and/or planarization.

In one embodiment, the relative movement between the workpiece 212 and the polishing pad 220 can both remove material from the workpiece 212, and remove deposits from the polishing pad 220, in a manner generally similar to that described above with reference to FIG. 2. In another embodiment, the workpiece 212 can be removed from the carrier 330 and replaced with a generally rigid member 312*a*, having a shape generally similar to that of the workpiece 212. During pad conditioning and/or activation, the carrier 330 can press the generally rigid member 312*a* into engagement with the polishing pad 220, thereby allowing the particles 252 (FIG. 2) in the polishing liquid 250 to clean the abrasive elements 226 (FIG. 2) in polishing pad 220. In a further aspect of this embodiment, the polishing liquid 250 can be placed on the polishing pad 220 with a dispenser 353, only during the conditioning operation. A separate polishing liquid (dispensed through the same dispenser 353 or a different dispenser) can be placed on the polishing pad 220 during workpiece polishing operations only. This workpiece polishing liquid can be rinsed from the polishing pad 220 prior to dispensing the conditioning/activating polishing liquid 250 shown in FIG. 3. This arrangement may be particularly suitable when the polishing liquid best suited to remove material from the workpiece 212 has a different composition than the polishing liquid best suited to remove deposits from the polishing pad 220. For example, the polishing liquid best suited for removing deposits from the polishing pad 220 may have particles with a different hardness, size, and/or concentration than the particles in a polishing liquid best suited for removing material from the workpiece 212. In another embodiment, the polishing liquid used to remove deposits from the polishing pad 220 can have suspended particles, while the polishing liquid used to remove material from the workpiece 212 can have no suspended particles.

Figure 4:
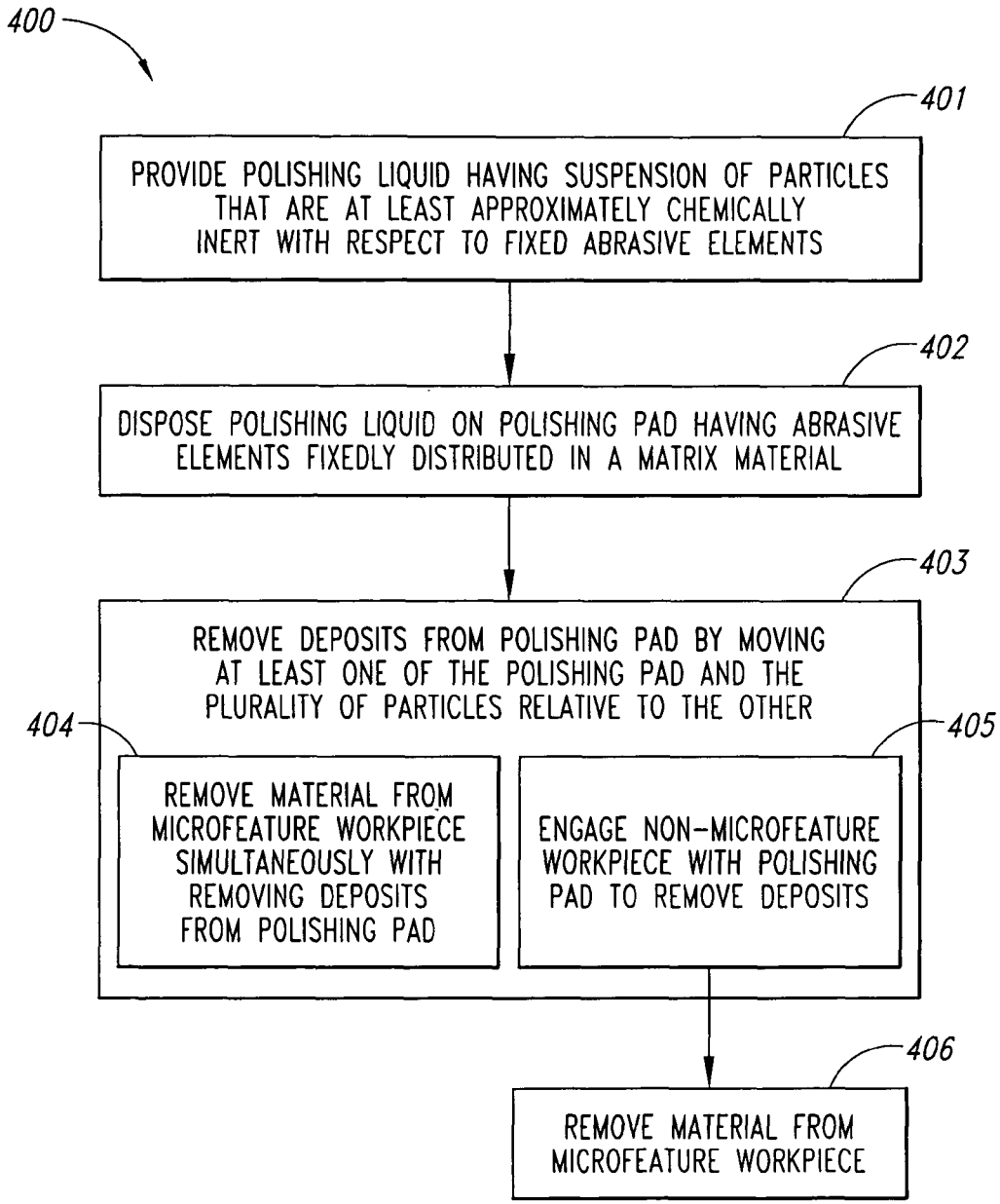
FIG. 4 is a flow diagram illustrating a method for removing deposits from a polishing pad in accordance with another embodiment of the invention.

FIG. 4 is a flow diagram illustrating a process 400 for removing deposits from a polishing pad in accordance with an embodiment of the invention. In process portion 401, the process 400 includes providing a polishing liquid having a suspension of particles that are at least approximately chemically inert with respect to fixed abrasive elements. The polishing liquid is disposed on a polishing pad having such abrasive elements fixedly distributed in a matrix material (process portion 402). In process portion 403, deposits are removed from the polishing pad by moving at least one of the polishing pad and the plurality of particles relative to the other.

Process portions 404 and 405 provide alternate methods for performing the deposit removal operation identified by process portion 403. For example, process portion 404 includes removing material from a microfeature workpiece simultaneously with removing deposits from the polishing pad. An example of this operation was described above with reference to FIG. 2. Process portion 405 includes engaging a non-microfeature workpiece with the polishing pad to remove deposits. An example of this operation was described above with reference to FIG. 3. Once the deposits have been removed from the polishing pad with a non-microfeature workpiece, material can then be removed from a microfeature workpiece (process portion 406) by engaging the microfeature workpiece with the polishing pad and moving at least one of the workpiece and the polishing pad relative to the other.

From the foregoing, it will be appreciated that specific embodiments of the invention have been described herein for purposes of illustration, but that various modifications may be made without deviating from the spirit and scope of the invention. For example, aspects of the invention described in the context of particular embodiments can be combined or eliminated in other embodiments. Accordingly, the invention is not limited except as by the appended claims.

I claim:

1. A method for using a polishing pad, comprising:

disposing a polishing liquid on a polishing surface of a polishing pad, the polishing pad including a matrix material and a plurality of abrasive elements fixedly distributed in the matrix material, the polishing liquid including a plurality of particles that are suspended in the polishing liquid and at least approximately chemically inert with respect to the abrasive elements;

contacting the polishing surface of the polishing pad with a semiconductor wafer in the presence of the polishing liquid to remove material from the semiconductor wafer, at least a part of the removed material forming deposits on the abrasive elements of the polishing pad; and moving at least one of the polishing pad and the plurality of particles relative to the other to remove the deposits from the abrasive elements of the polishing pad.

2. The method of claim 1 wherein disposing a polishing liquid includes disposing a polishing liquid having a plurality of particles with a polymeric, non-ceramic composition, a generally spherical shape, an average diameter in the range of from about 20 nanometers to about five hundred microns, and a concentration in the polishing liquid of from about 20 ppm to about 5%, and wherein the method further comprises:

moving at least one of the polishing pad and the semiconductor wafer relative to the other to remove material from the semiconductor wafer simultaneously with removing deposits from the polishing pad.

3. The method of claim 1, wherein disposing a polishing liquid includes disposing a polishing liquid having particles with a polymeric, non-ceramic composition.

4. The method of claim 1 wherein moving at least one of the polishing pad and the plurality of particles includes moving at least one of the polishing pad and the plurality of particles relative to the other to remove the deposits from the abrasive elements of the polishing pad without reducing a uniformity of the polishing surface.

5. The method of claim 1, further comprising placing a generally rigid member that does not include a microelectronic workpiece in contact with the polishing pad and the polishing liquid, and wherein removing deposits from the polishing pad includes moving at least one of the polishing pad and the generally rigid member relative to the other.

6. The method of claim 1 wherein disposing a polishing liquid includes disposing a polishing liquid having a plurality of particles with generally spherical shapes.

7. The method of claim 1 wherein disposing a polishing liquid includes disposing a polishing liquid having a plurality of particles with an average diameter in the range of from about 20 nanometers to about five hundred microns.

8. The method of claim 1 wherein disposing a polishing liquid includes disposing a polishing liquid having a plurality of particles with an average hardness that is less than a hardness of the abrasive elements.

9. The method of claim 1 wherein disposing a polishing liquid includes disposing a polishing liquid having a plurality of particles with an average size at least approximately the same as an average size of the abrasive elements.

10. The method of claim 1 wherein the polishing pad includes a plurality of projections and wherein the abrasive elements are housed in the projections, further wherein disposing a polishing liquid includes disposing a polishing liquid having a plurality of particles that are smaller than the projections.

11. The method of claim 1 wherein disposing a polishing liquid includes disposing a polishing liquid having a concentration of particles in the range of from about 20 ppm to about 5%.

12. The method of claim 1 wherein removing deposits from the polishing pad includes removing deposits without engaging an end effector with the polishing pad and without engaging a brush with the polishing pad.

13. The method of claim 1 wherein the polishing liquid is a first polishing liquid and wherein the method further comprises:

removing the first polishing liquid from the polishing pad;

disposing a second polishing liquid on the polishing pad, the second polishing liquid having a composition different than a composition of the first polishing liquid;

placing a semiconductor wafer in contact with the polishing pad and the second polishing liquid; and moving at least one of the polishing pad and the semiconductor wafer relative to the other to remove material from the semiconductor wafer.

14. A method for removing material from a semiconductor wafer, comprising:

disposing a polishing liquid on a polishing surface of a polishing pad, the polishing pad including a matrix material and a plurality of abrasive elements fixedly distributed in the matrix material, the polishing liquid including a plurality of particles that are at least approximately chemically inert with respect to the abrasive elements;

contacting a semiconductor wafer with the polishing pad to remove material from the semiconductor wafer;

depositing the removed material onto the abrasive elements of the polishing pad; and moving at least one of the polishing pad and the semiconductor wafer relative to the other to remove material from the semiconductor wafer while simultaneously removing the deposited material from the abrasive elements of the polishing pad.

15. The method of claim 14 wherein disposing a polishing liquid includes disposing a polishing liquid having a plurality of particles with a polymeric, non-ceramic composition, a generally spherical shape, an average diameter in the range of from about 20 nanometers to about five hundred microns, and a concentration in the polishing liquid of from about 20 ppm to about 5%.

16. The method of claim 14 wherein disposing a polishing liquid includes disposing a polishing liquid having a plurality of particles with a polymeric, non-ceramic composition.

17. The method of claim 14 wherein disposing a polishing liquid includes disposing a polishing liquid having a plurality of particles with generally spherical shapes.

18. The method of claim 14 wherein disposing a polishing liquid includes disposing a polishing liquid having a plurality of particles with an average diameter in the range of from about 20 nanometers to about five hundred microns.

19. The method of claim 14 wherein disposing a polishing liquid includes disposing a polishing liquid having a plurality of particles with an average hardness that is less than a hardness of the abrasive elements.

20. The method of claim 14 wherein disposing a polishing liquid includes disposing a polishing liquid having a plurality of particles with an average size at least approximately the same as an average size of the abrasive elements.

21. A method for removing material from a semiconductor wafer, comprising:

supporting a semiconductor wafer relative to a polishing pad, the polishing pad including a matrix material and a plurality of abrasive elements fixedly distributed in the matrix material;

disposing a polishing liquid on the polishing surface of the polishing pad, the polishing liquid including a plurality of particles that are at least approximately chemically inert with respect to the abrasive elements, wherein at least one of a size and a hardness of the particles is different than that of the abrasive elements of the polishing pad;

contacting the abrasive elements of the polishing pad with the semiconductor wafer to remove material from a surface of the semiconductor wafer;

depositing the removed material from the semiconductor wafer on the abrasive elements of the polishing pad; and scrubbing the abrasive elements with the particles in the polishing liquid to remove the deposited material from the abrasive elements of the polishing pad.

22. The method of claim 21, further comprising increasing a rate of removing the deposited material from the abrasive elements by increasing a concentration of the particles in the polishing liquid.

23. The method of claim 21 wherein disposing a polishing liquid includes disposing the polishing liquid on the polishing surface of the polishing pad before contacting the abrasive elements of the polishing pad with the semiconductor wafer.

* * * * *